US005182414A

United States Patent [19]

Takahashi

[11] Patent Number: 5,182,414

[45] Date of Patent: Jan. 26, 1993

[54] MOTIF PLAYING APPARATUS

[75] Inventor: Hideki Takahashi, Iwata, Japan

[73] Assignee: Kabushiki Kaisha Kawai Gakki Seisakusho, Japan

[21] Appl. No.: 628,639

[22] Filed: Dec. 14, 1990

[30] Foreign Application Priority Data

| | | | |
|---|---|---|---|
| Dec. 28, 1989 | [JP] | Japan | 1-338132 |
| Jan. 18, 1990 | [JP] | Japan | 2-7191 |
| Feb. 1, 1990 | [JP] | Japan | 2-20489 |

[51] Int. Cl.[5] ..... G10H 1/36; G10H 1/40; G10H 7/00

[52] U.S. Cl. ..... 84/634

[58] Field of Search ..... 84/609-611, 84/619, 634, 635, 649, 650, 651, 657, 666, 667

[56] References Cited

U.S. PATENT DOCUMENTS

| | | | |
|---|---|---|---|
| 4,344,345 | 8/1982 | Sano | 84/DIG. 12 X |
| 4,624,171 | 11/1986 | Yuzawa et al. | 84/DIG. 29 X |
| 4,664,010 | 5/1987 | Sestero | 84/650 |
| 4,704,932 | 11/1987 | Mishima | 84/DIG. 12 X |
| 4,876,936 | 10/1989 | Yeh | 84/612 |
| 4,881,440 | 11/1989 | Kakizaki | 84/609 |
| 4,926,737 | 5/1990 | Minamitaka | 84/611 |
| 4,957,032 | 9/1990 | Hirano et al. | 84/622 |
| 4,974,486 | 12/1990 | Wallace | 84/609 |
| 5,003,860 | 4/1991 | Minamitaka | 84/609 |

FOREIGN PATENT DOCUMENTS 2151897 6/1990 Japan .

*Primary Examiner*—William M. Shoop, Jr.
*Assistant Examiner*—Jeffrey W. Donels
*Attorney, Agent, or Firm*—Andrus, Sceales, Starke & Sawall

[57] ABSTRACT

A motif playing apparatus comprises a ROM for storing fixed ad-lib motif data, a RAM for reading out the fixed ad-lib motif data from the ROM and temporarily storing the read ad-lib motif data, a CPU for rewriting the fixed ad-lib motif data stored in the RAM to arbitrary ad-lib motif data, and a tone generator for generating a musical tone corresponding to the ad-lib motif data stored in the RAM. The CPU executes a process of assigning the arbitrary ad-lib motif data, which has replaced the fixed ad-lib motif data stored in the RAM, to a key on a keyboard.

This apparatus further has a switch to specify the length of ad-lib motif data at the time of assigning this data to the associated key.

Further, the apparatus is designed to be able to synchronously generate motif data indicating a motif of an accompaniment and motif data indicating a melody motif when a multi switch is depressed.

5 Claims, 20 Drawing Sheets

MOTIF PLAYING APPARATUS

BACKGROUND OF THE INVENTION

The present invention relates to a motif playing apparatus which automatically plays an ad-lib motif. More particularly, this invention is directed to a motif playing apparatus which can permit a user to change a fixed ad-lib motif to an arbitrarily one, specifically, to ad-lib motif having an arbitrary content and length, and can easily synchronize individual parts.

Recently, playing apparatuses (electronic musical instruments) having an auto play function to automatically perform a chord accompaniment are well known. To use such a playing apparatus with an auto play function to perform auto accompaniment, start the auto rhythm play first, then operate a key defined for the accompaniment. This key operation causes the playing apparatus to generate chord and root accompaniment tones assigned to this key interlockingly with the auto rhythm play.

Further, the present inventors have proposed an electronic musical instrument of the above type, which holds multiple types of motif data and plays a motif upon depression of a key assigned to select motif data, and have already filed a patent application for this instrument in Japanese Patent Office (Patent Application No. 63-306507).

According to such a playing apparatus, a motif is released based only on the content (motif data) stored in a fixed storage device, such as a ROM (Read Only Memory). Therefore, a user cannot freely alter the content, and the length of the motif to be generated is restricted to one bar, for example, thus limiting the user's enjoyment of playing music.

According to this type of motif playing apparatus, an automatic part, such as a rhythm, bass or chord, which is to be automatically played, and a melody part as an ad-lib motif, which is generated upon depression of the associated keys, should be synchronized at the proper timing by the user. Taking the exact timing is very difficult, and missing the timing would kill music.

SUMMARY OF THE INVENTION

It is therefore an object of the present invention to provide a motif playing apparatus capable of widening the range of selection of ad-lib motifs and increasing the enjoyment in playing music.

To achieve this object, according to one aspect of the present invention, there is provided a motif playing apparatus which comprises a ROM for storing fixed ad-lib motif data, a RAM for reading out the fixed ad-lib motif data from the ROM and temporarily storing the read ad-lib motif data, a CPU for rewriting the fixed ad-lib motif data stored in the RAM to arbitrary ad-lib motif data, and a tone generator for generating a musical tone corresponding to the ad-lib motif data stored in the RAM. More specifically, the CPU also executes a process of assigning the arbitrary ad-lib motif data, which has replaced the fixed ad-lib motif data stored in the RAM, to a key on a keyboard.

According to the present invention, the CPU is provided to rewrite the fixed ad-lib motif data stored in the RAM to arbitrary ad-lib motif data, and a user's or player's ad-lib is stored in the RAM so that it can be played again later upon depression of the associated key. More specifically, in a playing apparatus which has multiple pieces of ad-lib motif data prepared and plays an ad-lib motif when user depresses a key associated with the desired motif, it is possible to store melody data played by the user and assign the stored melody data to a key on the keyboard. This design can therefore widen the range of selection of ad-lib motifs, which provides a wider variety of play and increases the enjoyment in playing music.

To achieve the above object, according to another aspect of the present invention, there is provided a motif playing apparatus which comprises a CPU for assigning ad-lib motif data to those keys in a predetermined range (OFA area) on a keyboard having a plurality of keys, a switch for designating the length of ad-lib motif data assigned to a predetermined key by the CPU, a RAM for storing ad-lib motif data having the length designated by the CPU in association with each of those keys on the keyboard which are assigned by the CPU, and a tone generator for reading out the ad-lib motif data from the RAM in association with the keys assigned by the CPU and generating an associated musical tone.

According to the present invention, in storing arbitrary ad-lib motif data into a predetermined area in the RAM which corresponds to the associated key, an arbitrary length, such as one bar to several bars, can be specified, so that the user's ad-lib can be stored with the specified length in the RAM and can be played gain later when the associated key is depressed. This design can widen the range of selection of ad-lib motifs and increase the flexibility in playing music, thus ensuring a wider variety of music performance and increased enjoyment in playing music.

It is another object of the present invention to provide a motif playing apparatus which permits an accompaniment, such as rhythm, bass or chord, to be synchronized with a melody as an ad-lib motif to thereby ensure musical performance whoever depresses the key and whatever timing the depression is made.

To achieve this object, according to one aspect of the present invention, there is provided a motif playing apparatus which comprises a first memory (ROM or RAM) for storing motif data indicating a motif of an accompaniment, a second memory for storing motif data indicating a motif of a melody, an OFA switch for instructing motif playing of only an accompaniment or a melody, a multi switch for instructing motif playing of both an accompaniment and a melody, and a tone generator for reading motif data of only an accompaniment or a melody from first or second memory when an instruction is given by the OFA switch, and simultaneously reading out motif data of an accompaniment and a melody from the first and second memories when an instruction is given by the multi switch, and generating an associated musical tone.

According to this invention, with information representing a motif of an accompaniment such as rhythm, bass or chord, stored in one memory and information representing a melody motif stored in the other memory, a motif play only with the accompaniment or melody is possible when specified by the OFA switch and motif data of both the accompaniment and melody can simultaneously be released to generate the associated musical tones when specified by the multi switch. This design can solve the asynchronization of the automatic part, such as rhythm, bass or chord, with the motif part, which would occur in the prior art, and can realize a motif playing apparatus which permits an accompaniment, such as rhythm, bass or chord, to be synchronized with a melody as an ad-lib motif to thereby ensure musical performance whoever makes key depression at whatever timing.

DETAILED DESCRIPTION OF THE PREFERRED EMBODIMENT

Figure 1:
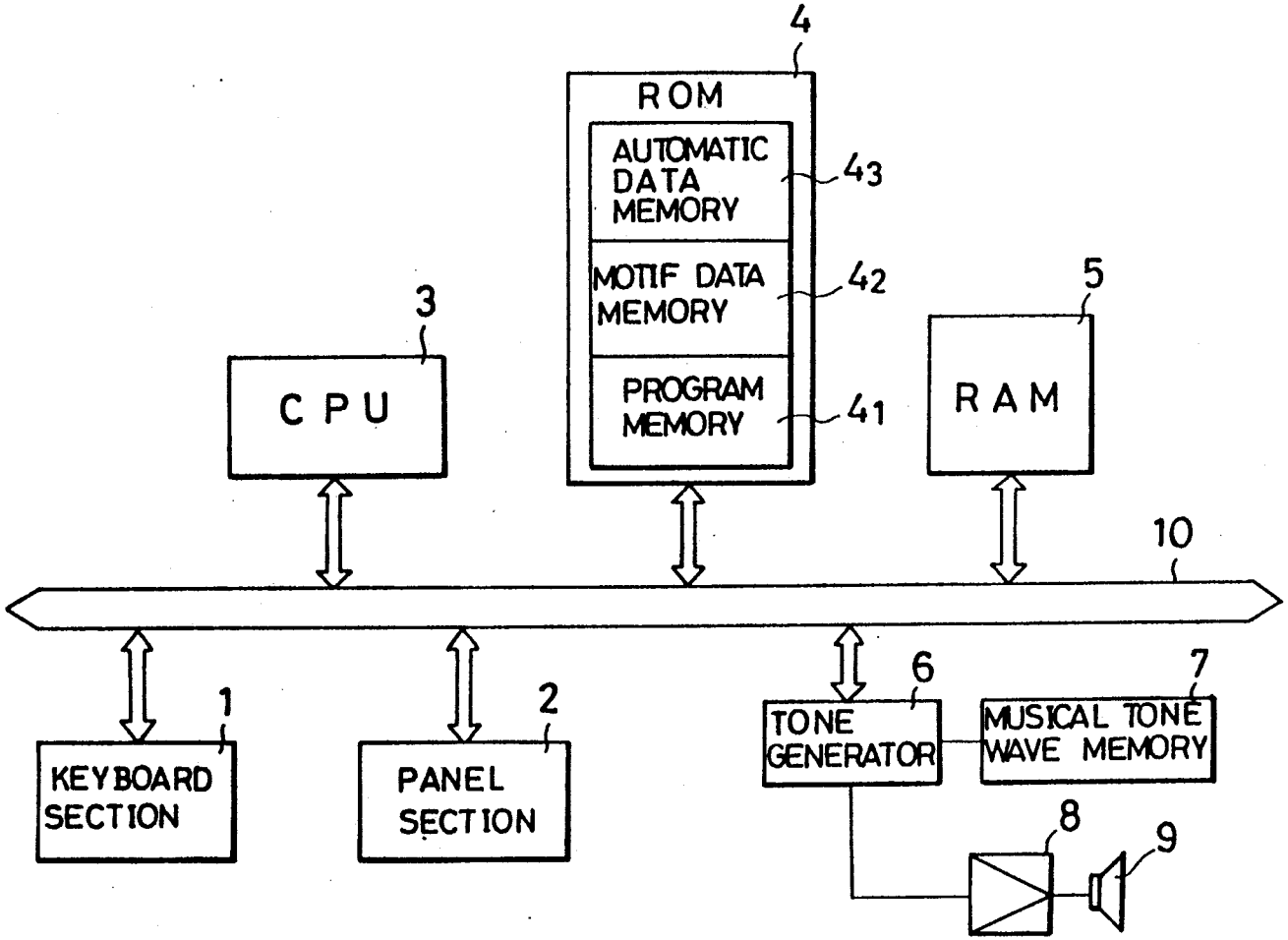
FIG. 1 is a block diagram illustrating the structure of a motif playing apparatus according to all the embodiments of the present invention.

FIG. 1 presents a block diagram common to all the embodiments of the present invention as will be described hereunder.

A keyboard section 1 comprises a keyboard having 61 keys, and a key scan circuit for detecting the depression (ON state) of each key.

A panel 2 includes a power switch, a mode set switch, a melody select switch, rhythm select switch, a one-finger ad-lib (OFA) switch for setting the OFA function, which directly concerns the characteristic of the present invention, a multi OFA switch, and a program switch to select a program to effect the OFA function. The status of each switch is detected by a scan circuit arranged in the panel 2 as in the keyboard 1. The structure of the panel 2 varies depending on the individual embodiments. The detailed description of the panel 2 will be give later.

A central processing unit (CPU) 3 controls individual sections of the motif playing apparatus of the present invention in accordance with a program stored in a program memory $4_1$ in a ROM 4.

The ROM 4 has a motif data memory $4_2$ and an automatic data memory $4_3$, besides the program memory $4_1$.

There are fixed ad-lib motif data, i.e., data for a melody motif, and data for other kinds of motifs, such as rhythm, chord, and bass, stored in the motif data memory $4_2$. The ad-lib motif data is formed by a combination of data of several continuous musical tones. The ad-lib motif data consists of note data of one or two bars (sometimes, a half or a quarter of a bar, or several bars), and holds a relatively short play pattern. The automatic data memory $4_3$ stores, for example, automatic play data, i.e., rhythm/chord/bass data.

A random access memory (RAM) 5 has an ad-lib motif pattern area and a working area comprising multiple registers. Under the control of the CPU 3, the ad-lib motif area stores the ad-lib motif data transferred from the motif data memory $4_2$ in the ROM 4. The multiple registers store data corresponding to the statuses of the individual keys on the keyboard 1 and the individual switches on the panel 2.

In a tone generator 6 there are a memory for storing musical tone data sent from the RAM 5, a generating section to generate a digital musical tone signal based on the musical tone data stored in that memory and wave data stored in a musical wave memory 7, and a D/A converter to convert such a digital musical tone signal to an analog musical tone signal.

The musical wave memory 7 is a ROM which has wave data and envelope data stored therein, and outputs the wave data and envelope data corresponding to the musical tone data stored in the tone generator 6. The wave data in the musical tone wave memory 7 is read out at a velocity (frequency) according to a key number stored in the tone generator 6.

The analog musical tone signal, the output of the D/A converter of the tone generator 6, is released as a sound through an amplifier 8 and a sound system 9 comprising a loudspeaker or a headphone.

The keyboard section 1, the panel 2, the CPU 3, the ROM 4, the RAM 5, and the tone generator 6 are mutually connected via a system bus 10.

Figure 2:
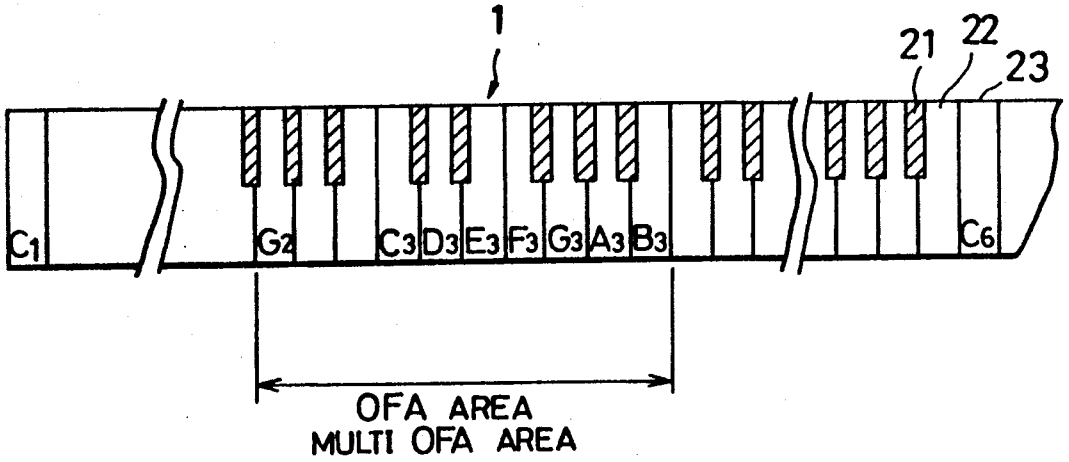
FIG. 2 is a diagram showing part of a keyboard section of every embodiment of the motif playing apparatus of the present invention.

FIG. 2 illustrates the keyboard section 1, and shall be referred to in common to all the embodiments of the present invention as will be discussed hereunder.

The keyboard section 1 has multiple keys. Part of this keyboard section 1 (17 keys from $G_2$ to $B_3$) is assigned as an OFA area. These keys when depressed specify seventeen types of ad-lib motifs individually in the motif program.

Keys 21 to 23 are used for specific applications. The key 21 is for settling the motif writing, the key 22 for changing the octave of the received motif, and the key 23 for erasing motif data stored in the RAM 5. These keys 21 to 23 are used to specify the pitch during the normal performance (in normal mode) as per the other keys.

FIRST EMBODIMENT

Figure 3:
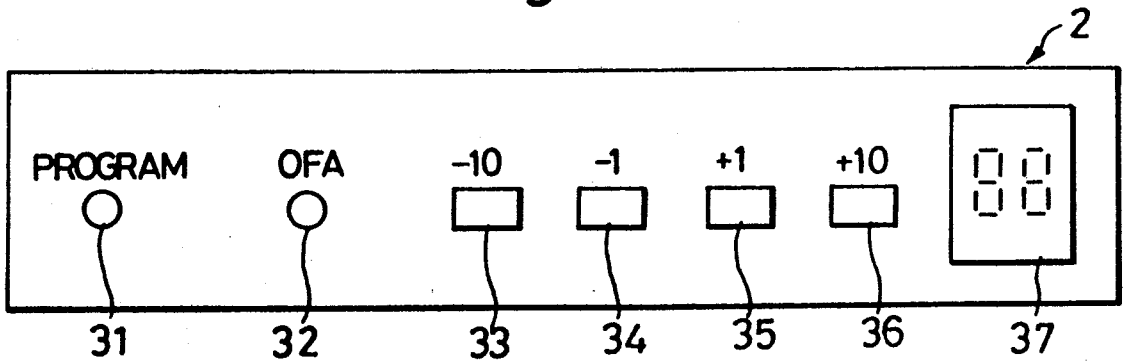
FIG. 3 is a diagram illustrating a panel according to the motif playing apparatus according to the first embodiment of the present invention.
Figure 4:
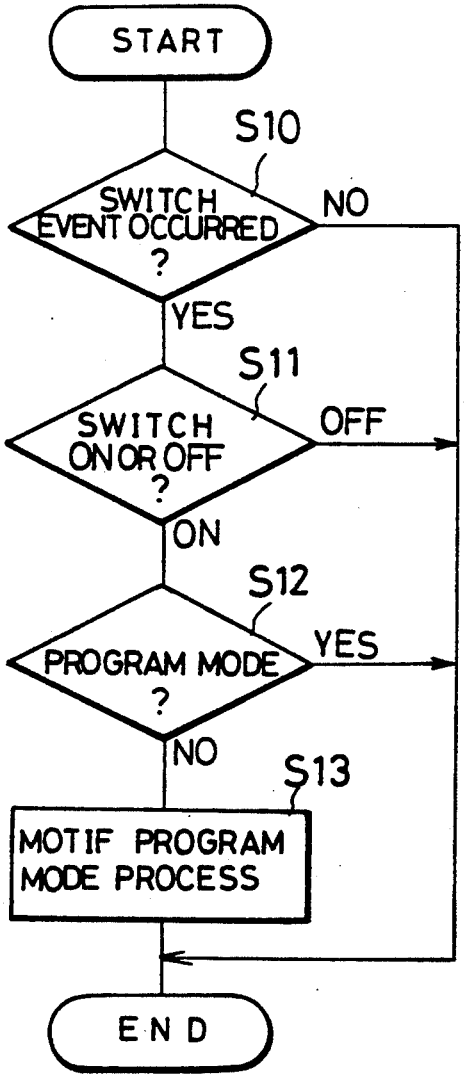
FIGS. 4 though 9 are flowcharts for explaining the operation of the motif playing apparatus according to the first embodiment.

FIG. 3 illustrates part of the panel 2 used in this embodiment.

The panel 2 includes a program switch 31 to set motif program mode in the working area in the RAM 5, a lamp 32 which is turned on in synchronism with the operation of this switch 31, switches 33–36 to set a timbre number of each motif (the switches 35 and 36 respectively increase the first digit (ones' position) and the second digit (tens' position) one by one, while the switches 33 and 34 respectively decrease the numeral of the tens' position and the number of the ones' position one by one), and a segment display 37 to display the timbre number of each set motif.

Though not directly relating to the technical matter of the present invention, the format of the ad-lib motif data stored in the motif data memory $4_2$ is disclosed in the Japanese Patent Application No. 63-306507 submitted earlier by the present applicant.

There are 17 types of ad-lib motif data for each rhythm, such as 16 beats, disco or bossa nova, and these types are associated with the respective keys in the OFA area of the keyboard section 1.

The ad-lib motif data includes not data and timbre data. The note data consists of a key number, gate time, velocity, and step time.

The operation of this embodiment will now be described in detail, referring to the flowcharts in FIGS. 4 to 9.

When the motif playing apparatus is powered on, the CPU 3 operable in accordance with a control program stored in the program memory $4_1$ in the ROM 4, transfers the ad-lib motif data stored in the motif data memory $4_2$ to the RAM 5 via the system bus 10. In the initial state, therefore, the RAM 5 has the same ad-lib motif data as stored in the ROM 4.

The transfer of the ad-lib motif data at the power-On time is executed as an initial process, prior to all the processes discussed hereunder.

MOTIF PROGRAM MODE PROCESS (FIG. 4)

This is a process to set the motif playing apparatus motif program mode.

With the program switch 31 of the panel 2 set ON, the CPU 3 receives change data of the program switch 31 from the scan circuit of the panel 2. The CPU 3 judges whether or not the status of the program switch 31 has changed to an ON state, i.e., if a switch event has occurred (step S10). When judging that the switch event has occurred, the CPU 3 determines whether this switch event is an "ON" event or "OFF" event (step S11).

If it is the "ON" event in the step S11, the CPU 3 determines if the motif playing apparatus is set in motif program mode, referring to mode information set in the working area of the RAM 5 (step S12). If it is judged that the apparatus is not in motif program mode, a motif program mode process will be executed (step S13).

In this motif program mode process, the CPU 3 reads out the motif corresponding to a key $G_2$ in the ad-lib motif data, which has been transferred to and stored in the ad-lib motif pattern area of the RAM 5, in respect to the rhythm, which has been selected through the panel 2 and set in the working area of the RAM 5. Then that motif is released by the tone generator 6, thereby notifying a user that the motif playing apparatus is now in motif program mode.

The motif corresponding to the key $G_2$ needs to be read out in this process because the key $G_2$ is initially set in the RAM 5 by the CPU 3. In this motif program mode, therefore, as each of the 17 keys in the OFA area of the keyboard section 1 is depressed, what is set in the associated register of the RAM 5 changes according to the depressed key, so that ad-lib motifs can be selected and released one after another.

PHRASE CLEAR PROCESS (FIG. 5)

This is a process to erase the motif data stored in the RAM 5.

When the key 23 on the keyboard section 1 is depressed, the CPU 3 receives change data of the key 23 from the scan circuit of the keyboard section 1. The CPU 3 judges whether or not the key 23 has been depressed, i.e., if the status of the key has changed to an ON state (steps S20 and S21).

If the switching event is "ON" in step S21, the CPU 3 judges if the motif playing apparatus is in motif program mode, or if the program switch 31 is ON, referring to the mode information set in the working area of the RAM 5 (step S22). When judging that motif program mode is set, the CPU 3 checks whether or not it is motif read mode (step S23). This decision is based on whether or not the depressed key is the key 23.

If the program mode is the motif read mode in this step, the selected phrase clear process is executed (step S24). In this process, the ad-lib motif pattern corresponding to the depressed key in the OFA area is erased. From this point in time, the data write mode is set in the registers of the RAM 5.

When it is not discriminated in step S22 that the motif playing apparatus is in motif program mode, the CPU 3 executes a normal keyboard process (step S25). In this normal keyboard process, each key in the OFA area is used to indicate a pitch.

OCTAVE OFFSET PROCESS (FIG. 6)

This process is for selecting the octave of the received motif.

When the key 22 on the keyboard section 1 is depressed, the CPU 3 receives change data of the key 22 from the scan circuit of the keyboard section 1. The CPU 3 determines if the status of the key 22 has changed to an ON state (steps S30 and S31).

If the switching event is the "ON" event in step S31, the CPU 3 judges if the motif playing apparatus is in motif program mode, or if the program switch 31 is ON, referring to the mode information set in the working area of the RAM 5 (step S32). Judging that motif program mode is set, the CPU 3 checks whether or not it is the motif read mode, i.e., if the motif write mode is set through the aforementioned phrase clear process (step S33).

If it is the motif write mode, not motif read mode, an octave offset data conversion process is executed (step S34). An octave shift in the octave offset data conversion process replaces to-be-input key numbers (corresponding to a pitch) with the numbers of keys shifted one-octave higher or lower. To realize the octave shifting, the key 22 has only to be used as a ring switch, and controlled to shift the number higher at the first depression and shift it lower at the second depression. Such a shift is concerned only with new data to be input, not the already-input data.

When it is not discriminated in step S32 that the motif playing apparatus is in motif program mode, the CPU 3 executes the normal keyboard process (step S35). In this normal keyboard process, each key in the OFA area is used to indicate a pitch.

KEY SWITCHING EVENT PROCESS (FIG. 7)

In this process, data is written into the RAM in motif write mode, in accordance with the depression of a key on the keyboard.

When any key on the keyboard section 1 is depressed, the CPU 3 receives change data of the key from the scan circuit of the keyboard section 1. The CPU 3 judges whether the status of any key has changed to the depressed state or released state ("ON" or "OFF") (steps S40 and S41)

If the switching event is the "ON" event in step S41, the CPU 3 judges if the motif playing apparatus is in motif program mode, or if the program switch 31 is ON, referring to the mode information set in tee working area of the RAM 5 (step S42). When judging that the motif program mode is set, the CPU 3 determines whether or not it is the motif read mode, i.e., if the motif write mode is set through the aforementioned phrase clear process (step S43).

If it is the motif write mode, not the motif read mode, the CPU 3 execute the data write process (step S44). In this data write process, the RAM 5 stores data, such as the key number, gate time, velocity and step time associated with the status of the depressed key in place of the ad-lib motif data which has been erased in the phrase clear process in FIG. 5. This operation can therefore permit a user to replace the fixed ad-lib motif data with ad-lib motif data prepared by the user.

When it is judged that the motif read mode has been set in step S43, the keys in the OFA area are used to read a motif, thereby allowing the motif associated with the depressed key to be read out from the RAM 5.

When it is not discriminated in step S42 that the motif playing apparatus is in motif program mode, the CPU 3 executes the normal keyboard process (step S45). In this normal keyboard process, each key in the OFA area is used to indicate a pitch.

INPUT DATA SETTLE PROCESS (FIG. 8)

This is a process to settle the data received through the data write process.

When the ad-lib data prepared by the user is input, and the key 21 on the keyboard section 1 is depressed, the CPU 3 receives key change data from the scan circuit of the keyboard section 1. The CPU 3 judges if the status of the key 21 has changed to an ON state (steps S40 and S41).

If the switching event is the "ON" event in step S51, the CPU 3 judges if the motif playing apparatus is in motif program mode (or if the program switch 31 is ON), referring to the mode information set in the working area of the RAM 5 (step S52). Upon judging that motif program mode is set, the CPU 3 executes a motif information read process (step S53). In this process (step S53), the content of the RAM 5 is altered to change the mode from the motif write mode back to the motif read mode. At the same time the ad-lib motif data corresponding to the key $G_2$ is read out.

The ad-lib motif data, received from the keyboard section 1 and written into the RAM 5 during motif write mode, is settled in the above-described sequence of processes. Further storing the settled data in five memories, each serving as a user area in the RAM 5, can permit the user to freely use these pieces of data later for arrangement.

Figure 5:
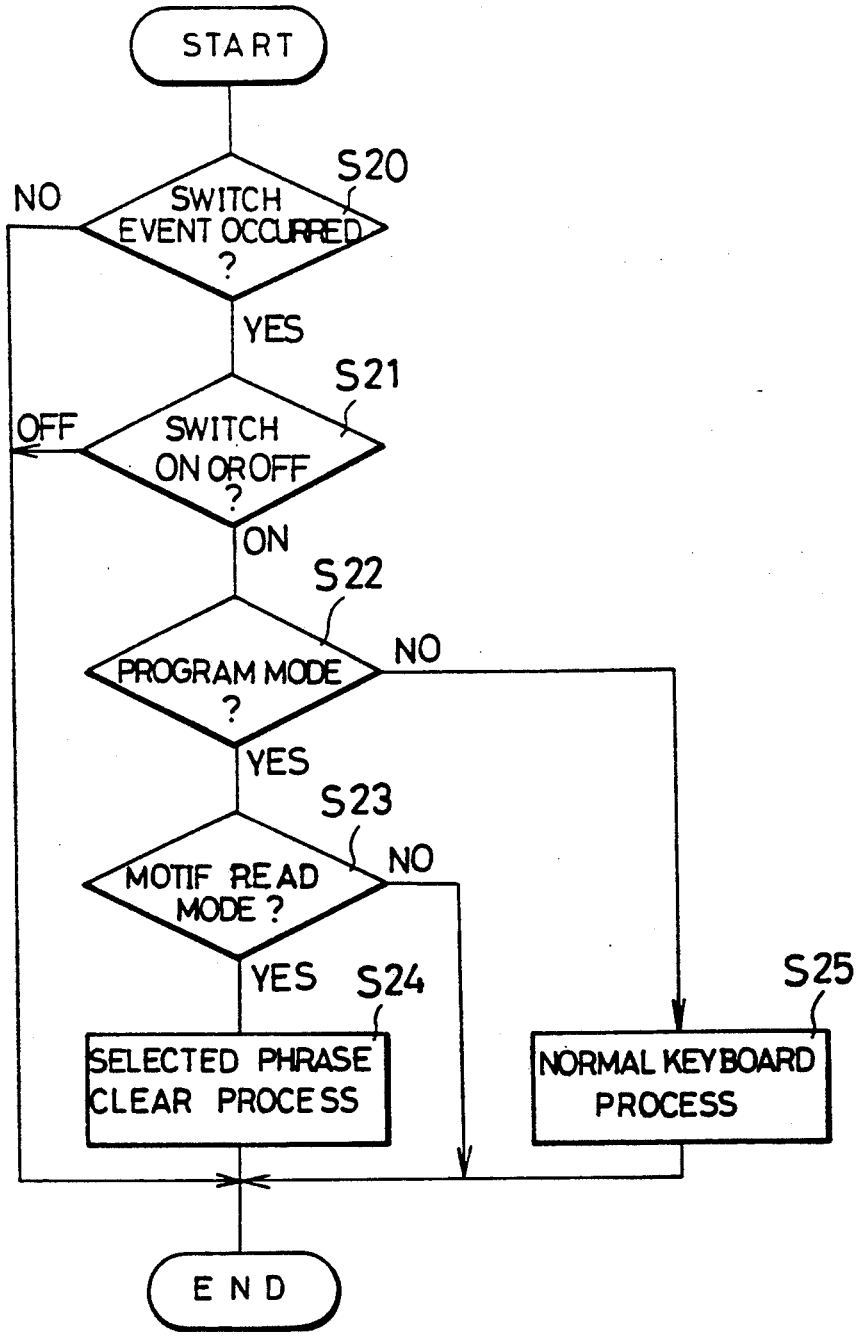
Figure 6:
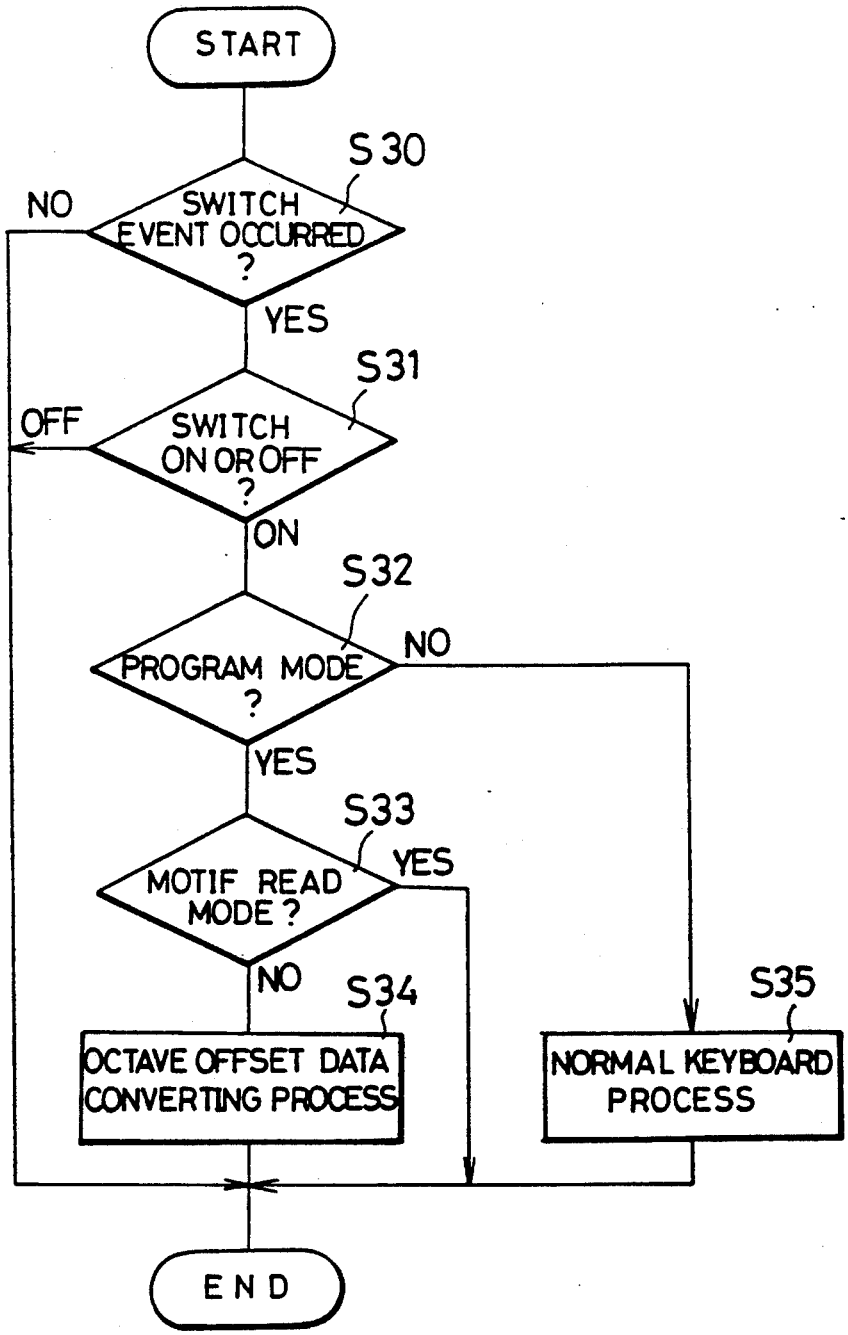
Figure 7:
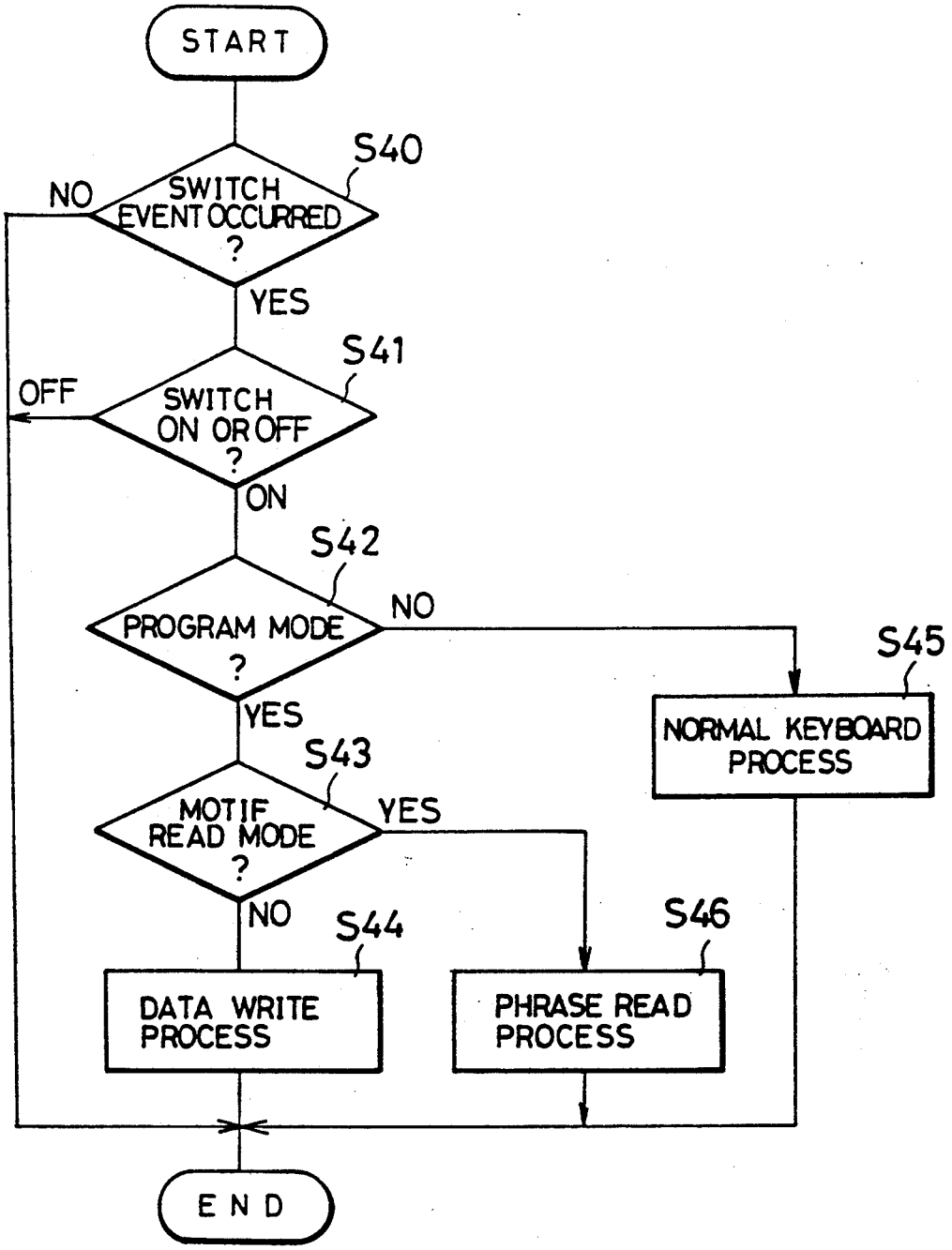
Figure 8:
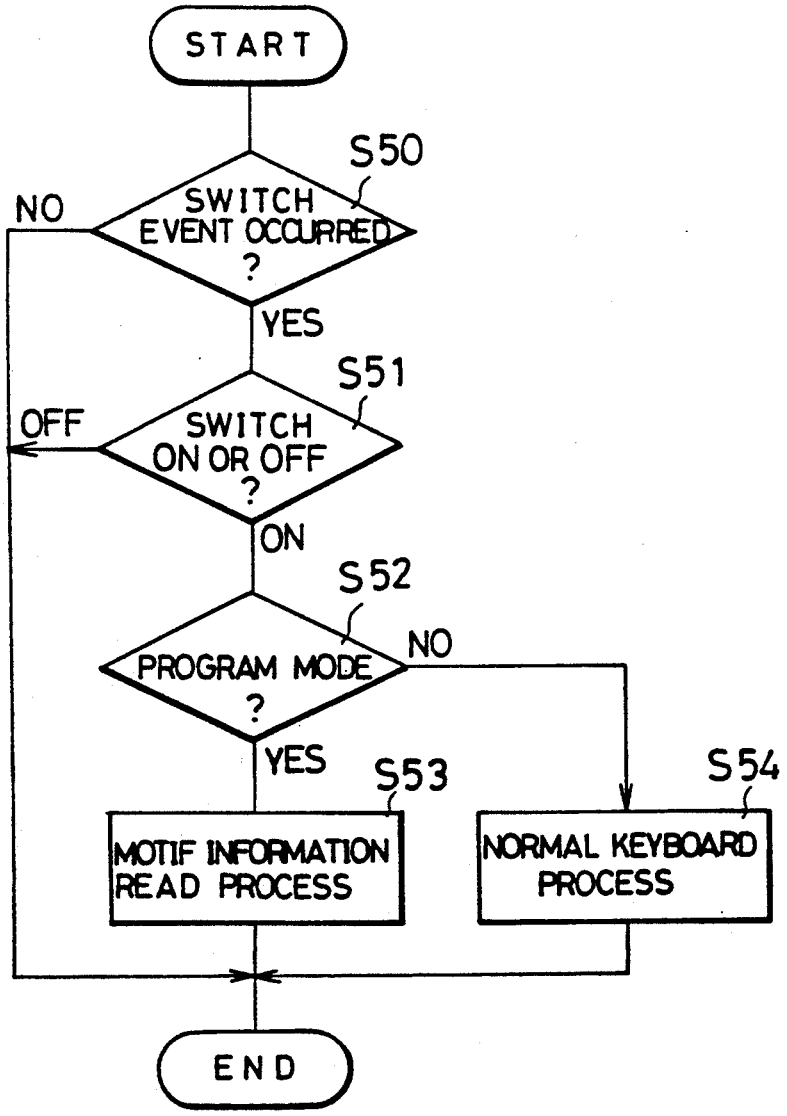
Figure 9:
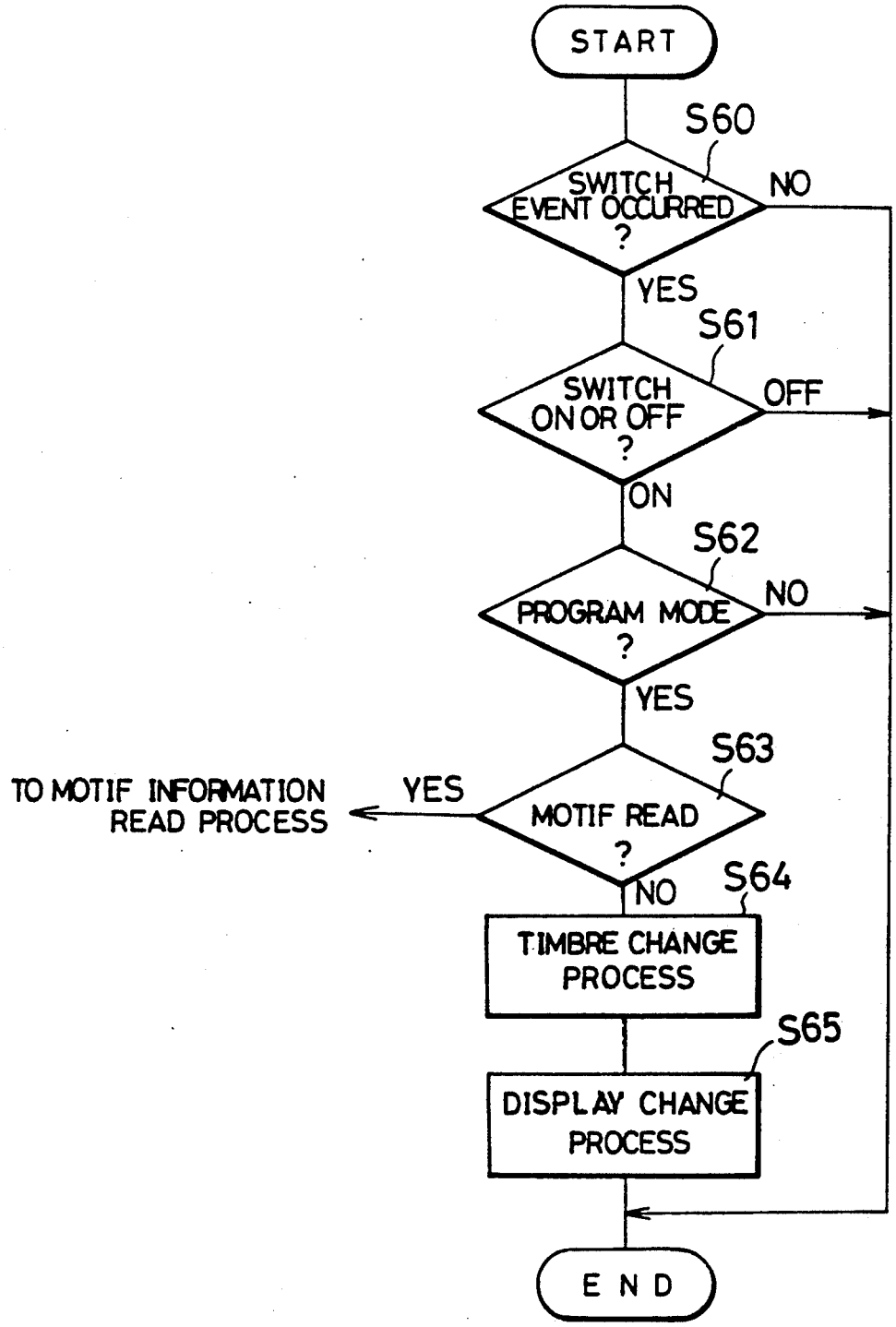

When it is not discriminated in step S52 that the motif playing apparatus is in motif program mode, the CPU 3 executes the normal keyboard process in the same manner as shown in FIG. 5 (step S54). In this normal keyboard process, the individual keys in the OFA area are used to indicate pitches.

TIMBRE CHANGE PROCESS (FIG. 9)

In this process a timbre number is changed by the melody switch (not shown) on the panel 2 in motif write mode.

When the melody switch of the panel 2 is operated and the timbre number is changed by the switches 33 to 36, the CPU 3 receives change data from the scan circuit of the panel 2, and determine the change (ON or OFF) of the timbre number (steps S60 and S61).

If the switching event is the "ON" event in step S61, the CPU 3 judges if the motif playing apparatus is in motif program mode, or if the program switch 31 is rendered ON, referring to the mode information set in the working area of the RAM 5 (step S62). Upon judging that the motif program mode has been set, the CPU 3 checks whether or not it is the motif read mode, i.e., if the motif write mode is set through the aforementioned phrase clear process (step S63).

If it is not motif read mode but motif write mode, the CPU 3 executes the timbre change process (step S64) and a display change process (step S65).

The timbre change process is a process to replace the timbre number set in the RAM 5 with the timbre number indicated by the switches 33 to 36. The segment display 37 changes the what is shown thereon through the display change process, showing the new timbre number.

SECOND EMBODIMENT

Figure 10:
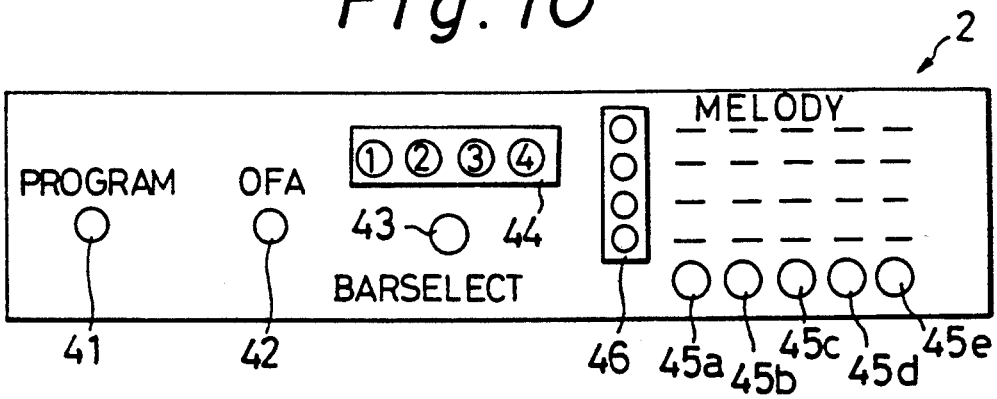
FIG. 10 is a diagram illustrating a panel according to the motif playing apparatus according to the second embodiment of the present invention.

FIG. 10 illustrates part of the panel 2 used in this embodiment. The panel 2 has a program switch 41 to set the motif program mode in the working area in the RAM 5, an OFA switch 42 to read out a motif, a bar select switch 43 to select the number of bars that should be memories per key, an indicator 44 to show the selected status of this switch 43, timbre change switches 45*a* to 45*e* to select the timbre of each motif and a display 46 to show the position of the selected timbre.

Figure 11A:
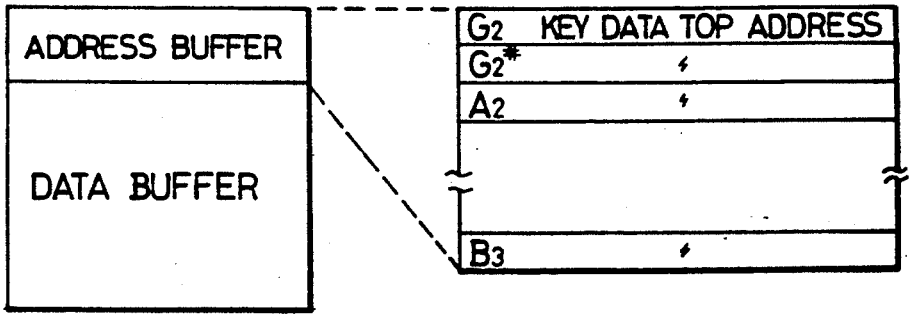
FIGS. 11A and 11B are diagrams showing an ad-lib motif pattern area in a RAM.
Figure 11B:
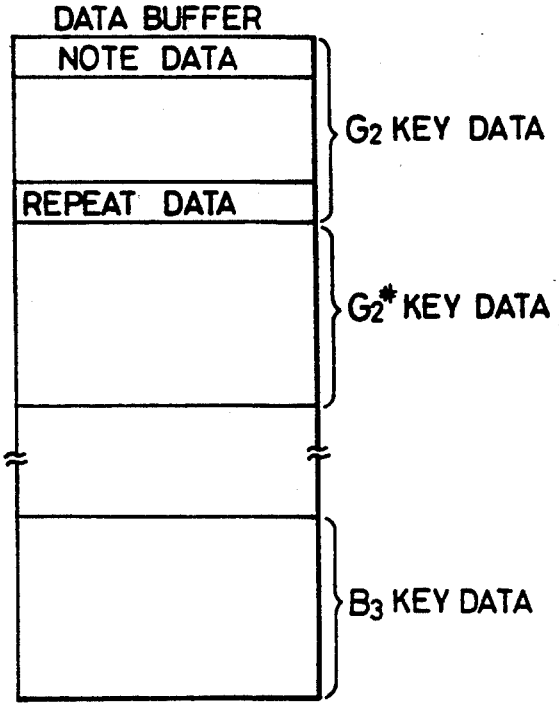
Figure 13:
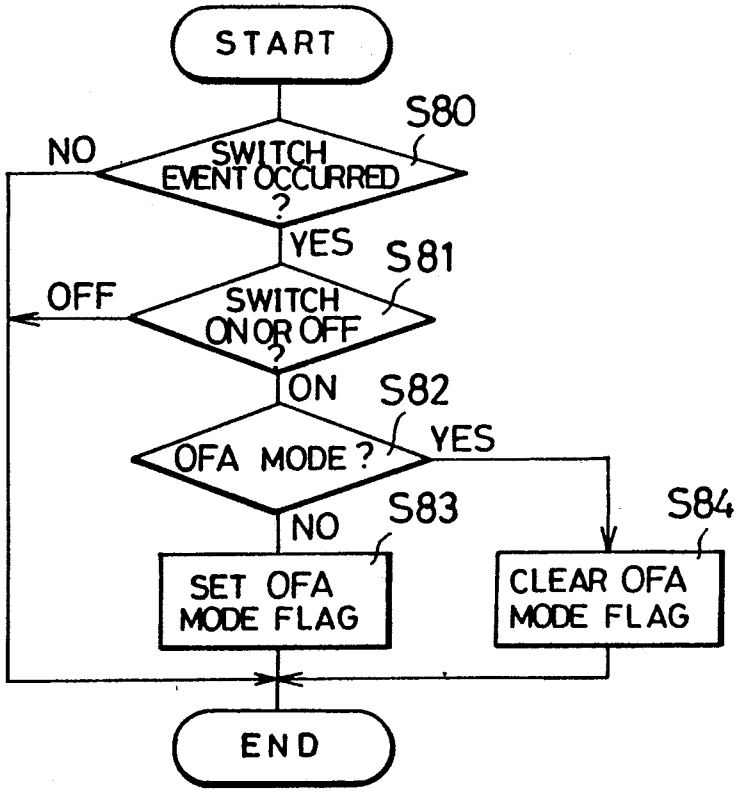
Figure 12:
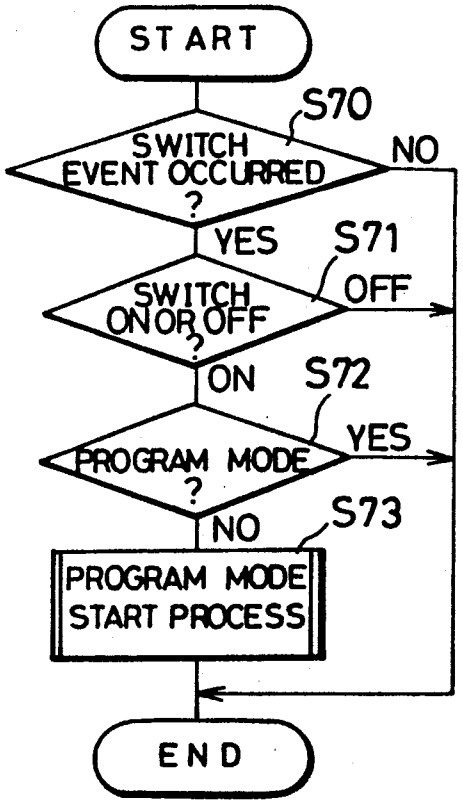
FIGS. 12 though 17 are flowcharts for explaining the operation of the motif playing apparatus according to the second embodiment.
Figure 14:
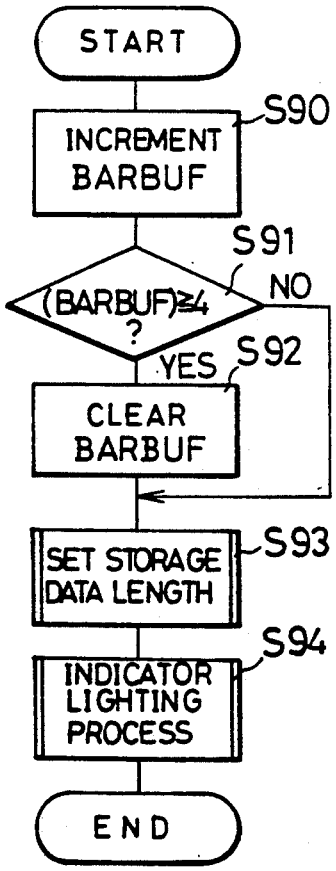
Figure 15:
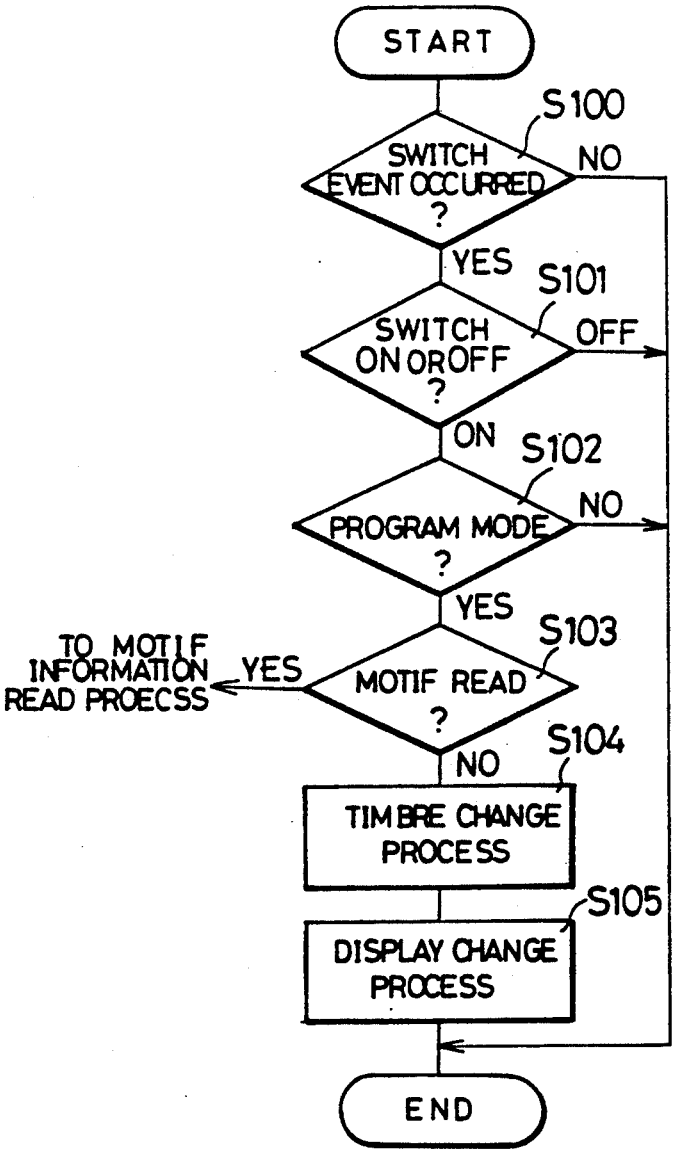

FIG. 11 illustrates the format of the ad-lib motif data to be stored in an ad-lib motif pattern area in the RAM 5. As shown in FIG. 11A, the ad-lib motif pattern area consists of an address buffer and a data buffer. The address buffer stores the top addresses of areas where the ad-lib motif data corresponding to the individual keys ($G_2$-$B_3$) in the OFA area of the keyboard are stored. For instance, "$G_2$ key data top address" is stored for the key $G_2$, and this address indicates the location where the ad-lib motif data corresponding to the key $G_2$ is stored. The same applied to the other keys. As shown in FIG. 11B, the data buffer stores ad-lib motif data consisting of plural pieces of note data and repeat data in association with the individual keys ($G_2$-$B_3$)

The data format of the ad-lib motif data is the same as that of the first embodiment, and is disclosed in Japanese Patent Application No. 63-306507.

There are plural types of ad-lib motif data for each rhythm, such as 16 beats, disco or bossa nova, and these types are associated with to the respective keys in the OFA area of the keyboard section 1.

For instance, the ad-lib motif data of a melody includes note data and timbre data. The note data consists of a key number, gate time, velocity, and step time. The timbre data include a melody timbre number.

The operation of this embodiment having the above arrangement will now be described in detail, referring to the flowcharts in FIGS. 12 to 17.

The transfer of ad-lib motif data at the time the motif playing apparatus is powered on is executed as an initial process, prior to all the processes discussed hereunder, as in the first embodiment.

PROGRAM MODE START PROCESS (FIG. 12)

With the program switch 41 of the panel 2 set ON, the CPU 3 receives change data of the program switch 41 from the scan circuit of the panel 2. The CPU 3 judges whether or not the status of the program switch 41 has changed to an ON state, i.e., if a switch event has occurred (step S70). When judging that the switch event has occurred, the CPU 3 determines whether this switch event is an "ON" event or "OFF" event (step S71).

If it is the "ON" event in the step S71, the CPU 3 determines if the motif playing apparatus is set in motif program mode, referring to the mode information set in the working area of the RAM 5 (step S72). If it is judged that the apparatus is not in motif program mode, a program mode start process will be executed (step S73).

In this program mode start process, the CPU 3 initializes various program flags, which will be required for later processing, and the bar select switch. Through the initialization, the bar selection is set to "one bar" that is the initial value, and the leftmost lamp (①) of the indicator 44 is lit. Performing a metronome process in this program mode start process generates a sound indicating a tempo. As a result, the user can play a melody, for example, according to the tempo, and the melody is sequentially stored as ad-lib motif data in the RAM 5.

If it is judged in step S72 that the motif playing apparatus has already been set in program mode, the CPU 3 terminates the sequence of processes without executing the program mode start process.

OFA MODE FLAG PROCESS (FIG. 13)

This process is to set or reset the OFA mode flag.

With the OFA switch 42 of the panel 2 set ON, the CPU 3 receives change data of the OFA switch 42 from the scan circuit of the panel 2. The CPU 3 judges whether or not the status of the OFA switch 42 has changed to a depressed (ON) state, i.e., if a switch event has occurred (steps S80 and S81).

If it is the "ON" event in the step S81, the CPU 3 determines if the motif playing apparatus is set in OFA mode, or if the OFA switch 42 is operated, referring to the mode information set in the working area of the RAM 5 (step S82). If it is judged the mode is not the OFA mode, the OFA mode flag provided in the working area in the RAM 5 is set and the OFA mode flag process is terminated (step S83). If it is judged in step S82 that the OFA mode has been set, the OFA mode flag provided in the working area in the RAM 5 is cleared, and the OFA mode flag process is terminated (step S84).

Through the above operation, every time the OFA switch 42 is depressed, a toggle operation of alternately setting and resetting the OFA mode flag is effected. This toggle operation determines whether the apparatus should function in OFA mode or normal mode.

BAR NUMBER SELECT PROCESS (FIG. 14)

When the bar select switch 43 is depressed, this routine is called to select the number of bars.

In this bar number select process, the number of bars that should be memorized per key is changed in circulation from "1" to "2" to "3" to "4" then back to "1" and so forth every time the bar select switch 43 is depressed, and the selected number is shown on the indicator 44 while this number is stored in a BARBUF area provided in the working area in the RAM 5.

More specifically, when the routine of the bar number select process starts upon depression of the bar select switch 43, the content of the BARBUF is incremented (step S90). Then, it is checked if the content of the BARBUF exceeds "4" (step S91). When it is judged that the value is equal to or greater than "4," the BARBUF area is cleared (step S92). If the decision is that the content is lower than "4," this step S92 would be skipped. In this manner, the aforementioned circulation of the number, 1→2→3→4→1 ..., is realized.

Subsequently, the length of data to be stored is set (step S93). That is, the status of the selection (bar number) stored in the BARBUF area is stored in a predetermined area in the working area. The data held in the predetermined area, indicating the number of bars, will be referred to at a later time of writing and reading (playing) address motif data. In the next step S94, a process of lighting the indicator 44; in this process that lamp of the indicator 44 which is associated with the data stored in the BARBUF area is lit.

TIMBRE CHANGE PROCESS (FIG. 15)

This process is to alter the timbre number by the operation of the timbre select switches on the panel 2.

With any of the select switches 35*a*–35*e* of the panel 2 is depressed, the CPU 3 receives change data from the scan circuit of the panel 2 and determines a status change (ON or OFF) of the switches 35*a*–35*e* (steps S100 and S101).

If the decision in step S101 indicates the "ON" event, the CPU 3 determines if the motif playing apparatus is set in program mode (or if the program switch 41 is operated), referring to the mode information set in the working area of the RAM 5 (step S102). If it is determined that the program mode is now set, the CPU 3 checks if it is the motif read mode (step S103).

If it is judged that the mode is not the motif read mode, i.e., it is the motif write mode, the timbre change process (step S104) and the display change process (step S105) would be executed.

The timbre change process is a process to replace the timbre number set in the RAM 5 with the timbre number specified by the switches 35*a* to 35*e*. The display 46 changes the what is shown thereon through the display change process, showing the new timbre number.

KEY SWITCHING EVENT PROCESS (FIGS. 16A AND 16B)

This process is executed in association with the depression of each key on the keyboard 1.

When any key on the keyboard section 1 is depressed, the CPU 3 receives change data of the key from the scan circuit of the keyboard section 1. The CPU 3 judges whether the status of any key has changed to the depressed state or released state ("ON" or "OFF") (steps S110 and S111).

If the switching event is the "ON" event in step S111, the CPU 3 discriminates if the motif playing apparatus is in motif program mode (or if the program switch 41 is ON), referring to the mode information set in the working area of the RAM 5 (step S112). If it is determined that the program mode is now set, keyboard information write process is executed (step S116). This process is carried out in the following manner. In the first keyboard information write process, $G_2$ key data top address is set in the address buffer area in the RAM 5. Then, tone data corresponding to the key operated by the user, such as the key number, gate time, velocity and step time, is stored in the data buffer area indicated by this $G_2$ key data top address. Then, the same information as written in the aforementioned keyboard information write process is sent to the tone generator 6 to execute a tone-ON process (step S117). The above completes the key switching event process at the ON event time.

If it is judged in step S112 that the mode is not the program mode, it is checked if the mode is an OFA play mode (step S113). If it is not even the OFA play mode, a tone-ON process for normal key depression is performed (step S117). If it is judged in step S113 that the OFA play mode is now set, then it is checked if the depressed key belongs to those keys in the OFA area shown in FIG. 2 (step S114). If the key is other than those in the OFA area, the normal keying-oriented tone-ON process is likewise executed (step S117). If the depressed key is judged to be one of the keys in the OFA area, the motif read process is executed (step S115) to play the ad-lib motif.

During the program mode, the timbre can be changed using the switches 35*a*–35*e* and various tone effects can be produced operating other switches, and these pieces of information are all stored as key data in the ad-lib motif pattern area in the RAM 5.

Figure 16A:
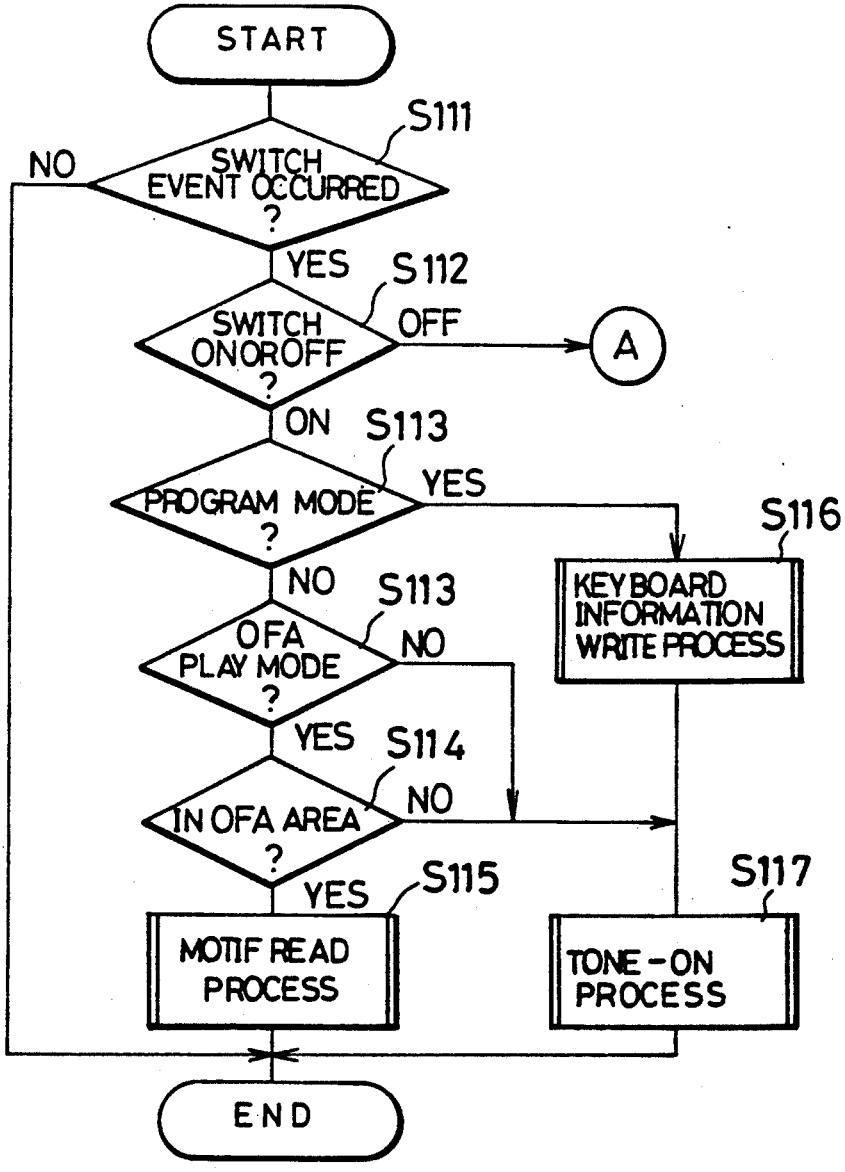
Figure 16B:
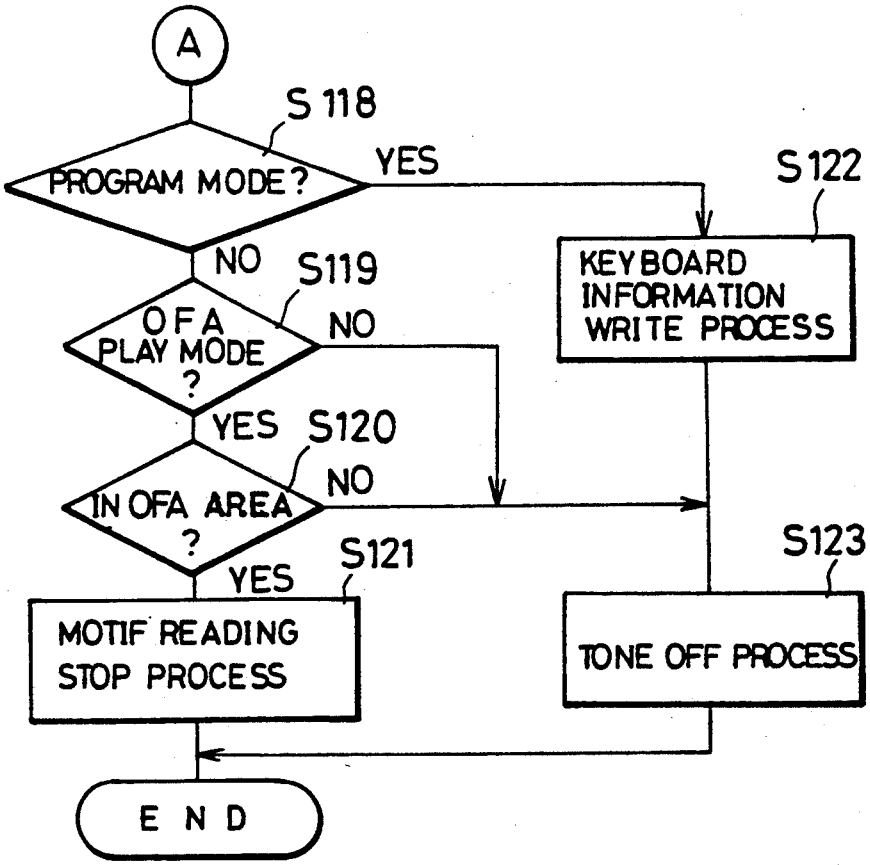
Figure 17:
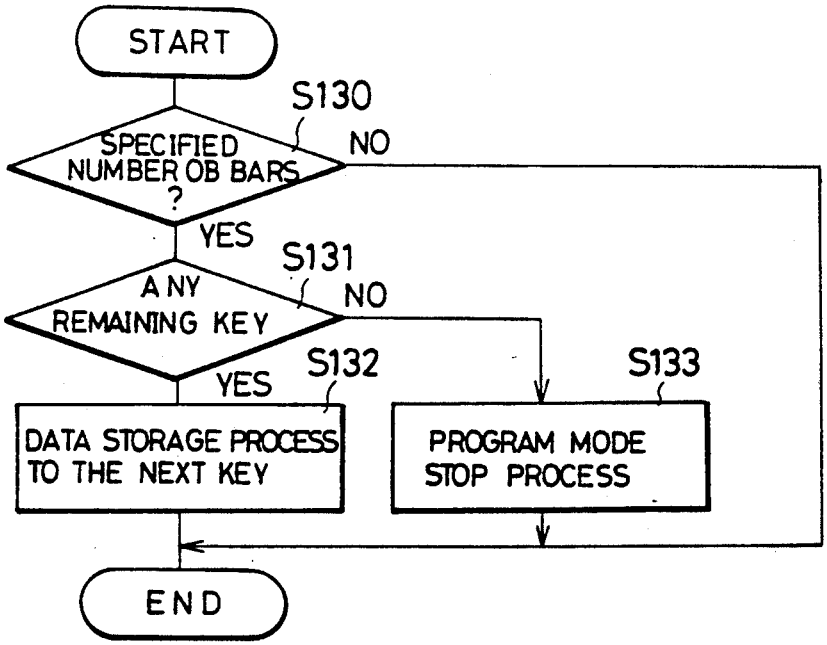

If it is determined in steps S110 and S111 that a key releasing (OFF event) has occurred, the CPU 3 refers to the mode information stored in the working area in the RAM 5 to check if the program mode is now set (step S118), as shown in FIG. 16B. If the decision reflects the setting of the program mode, the keyboard information write process is executed (step S122). As this keyboard information write process is the same as carried out in the aforementioned step S116, its explanation will be omitted. Then, the same information as written in the keyboard information write process is sent to the tone generator 6 to execute a tone-OFF process (step S123). The above completes the key switching event process at the OFF event time.

If it is judged in step S118 that the mode is not the program mode, it is checked if the mode is an OFA play mode (step S119). If it is not even the OFA play mode, a normal key-releasing oriented tone-OFF process is performed (step S123). If it is judged in step S119 that the OFA play mode is now set, then it is checked if the depressed key is one of those keys in the OFA area shown in FIG. 2 (step S120). If the key is other than those in the OFA area, the normal key-releasing oriented tone-OFF process is executed (step S123). If the released key is judged to be one of the keys in the OFA area, a motif read stop is executed (step S121). That is, the ad-lib motif play is stopped.

KEY DATA ASSIGNING PROCESS (FIG. 17)

In this process, it is checked how far the bar has progressed in a predetermined cycle by means of a timer or the like in addition to the data input from the keyboard, and a process concerning the number of bars to be assigned to a single key is executed.

First, the CPU 3 checks at a predetermined timing whether or not the number of bars specified by the bar select switch 43 has reached (step S130), and terminates this key data assigning process if the specified bar number has not been reached. If the specified bar number has been reached, on the other hand, i.e., if the bars assigned to one key are completed, it is checked if there is any key remaining in the OFA area (step S131). In other words, it is determined whether or not there still remains any key in the OFA area shown in FIG. 2 to which no data is assigned yet. If it is judged that there is such a key, a data storage process to the next key is executed (step S132). If it is judged that there remains no such a key, on the other hand, a program mode stop process is executed (step S133), stopping the writing of the ad-lib motif data.

In short, the above-described processing is executed as follows. Operating the program switch 41 changes the normal mode to the program mode, for example, the melody storing mode. Then a metronome ticks in accordance with the tempo value set through the panel 2. Playing the keyboard in this condition starts the recording. That is, a melody played by the user is sequentially stored in the ad-lib motif area in the RAM 5 according to the number of bars to be assigned to one key, which has been set by operating the bar select switch 43. This writing process will be executed as follows. First, the $G_2$ key data top address is set in the address buffer area of the RAM 5. Then, the note data corresponding to the depressed key, such as the key number, gate time, velocity and step time, is sequentially stored in the data buffer area indicated by the $G_2$ key data top address. When the storing operation progresses and the number of bars set by the bar select switch 43 is reached, writing the repeat data and a process to the $G_2$ key data are terminated, followed by a process of setting the $G_2$# key data top address in the address buffer in the RAM 5. Thereafter, the writing of the key data is carried out in the same manner. When the writing of the $B_3$ key data is completed, the program mode is ended, and the operation leaves the melody storing mode and returns to the normal mode.

With regard to data reproduction, when any of the $G_3$ to $B_3$ keys is depressed in OFA mode, information association with that key is read out and released, playing a motif.

As described above, in storing arbitrary ad-lib motif data into the ad-lib motif pattern area in the RAM 5 which corresponds to a key, an arbitrary number of bars, such as one bar to several bars, can be specified by the bar select switch 43, so that the user's ad-lib can be stored with the specified bar number in the RAM 5 and can be played gain later when the associated key is depressed. This design can therefore widen the range of selection of ad-lib motifs and increase the flexibility in playing music, thus ensuring a wider variety of music performance and increased enjoyment in playing music.

Although the number of bars which can be specified ranges from one bar to four bars in the above embodiment, it is of course possible to select any greater number. In this case, the flexibility of the ad-lib play would further increase.

THIRD EMBODIMENT

Figure 18:
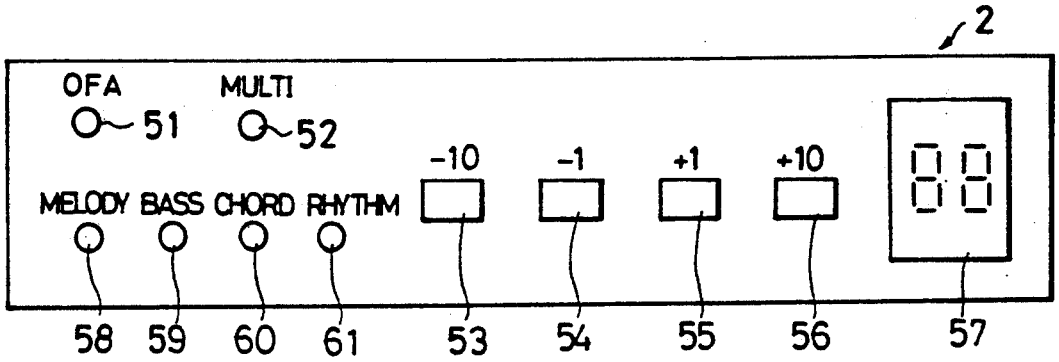
FIG. 18 is a diagram illustrating a panel according to the motif playing apparatus according to the third embodiment of the present invention.
Figure 19:
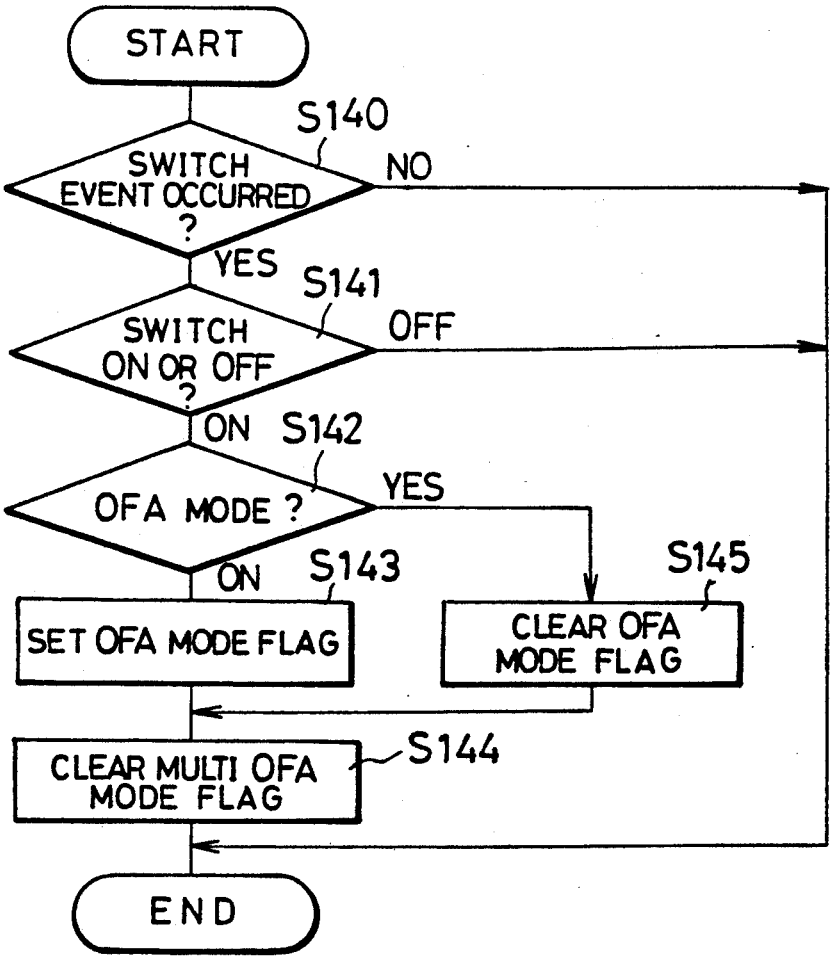
FIGS. 19 though 24 are flowcharts for explaining the operation of the motif playing apparatus according to the third embodiment.
Figure 20:
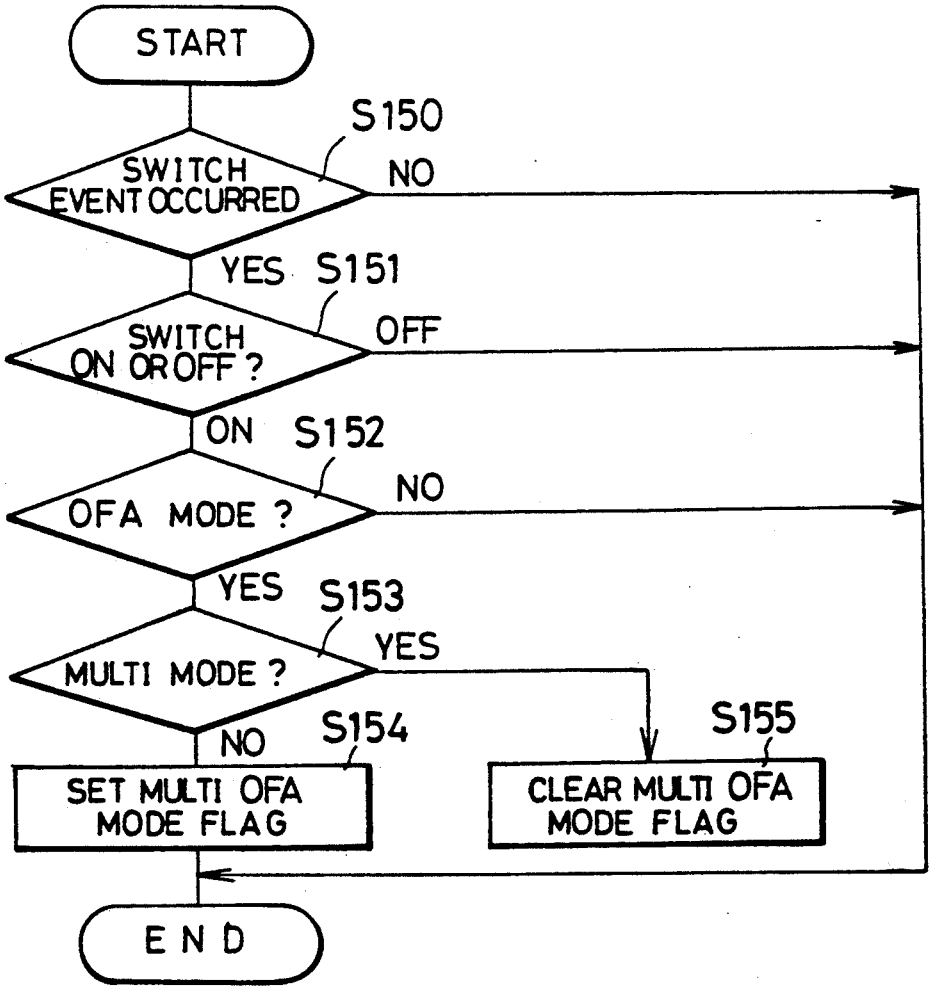

FIG. 18 illustrates part of the panel 2 used in this embodiment.

The panel 2 has an OFA switch 51 to set a motif play mode (OFA mode), the same as that of the second embodiment, a multi switch 52 to set a multi mode to generate all the parts, a switch 58 to set a melody switching mode, a switch 59 to set a bass switching mode, a switch 60 to set a chord switching mode, and switches 53 to 56 to set the timbre/rhythm number in each of the above-mentioned switching modes (having the same functions as the switches 33–36 of the first embodiment).

The panel 2 is further provided with a segment display 57 to display the timbre/number of each set motif.

The data format of the ad-lib motif data to be stored in the motif data memory $4_2$ is the same as that of the first embodiment, and is disclosed in Japanese Patent Application No. 63-306507.

There are plural types of ad-lib motif data for each rhythm, such as 16 beats, disco or bossa nova, and these types are associated with the respective keys in the OFA area or multi OFA key of the keyboard section 1.

The ad-lib motif data includes note data and timbre data. The note data consists of a key number, gate time, velocity, and step time.

The operation of this embodiment with the above arrangement will now be described in detail, referring to the flowcharts in FIGS. 19 to 24.

When the power switch of the motif playing apparatus is set on, an initial process of transferring ad-lib motif data to the RAM 5 from the ROM 4 is executed prior to all the processes discussed hereunder, as in the first embodiment.

OFA MODE START PROCESS (FIG. 19)

When the OFA switch 51 of the panel 2 is rendered ON to set the OFA mode, the CPU 3 receives change data of the OFA switch 51 from the scan circuit of the panel 2. The CPU 3 determines whether or not the status of the OFA switch 51 has changed to an ON state, i.e., if a switch event has occurred (step S140). Upon judging that the switch event has occurred, the CPU 3 determines whether this switch event is an "ON" event or "OFF" event (step S141).

If it is the "ON" event in the step S141, the CPU 3 determines if the motif playing apparatus is set in OFA mode, referring to the mode information set in the working area of the RAM 5 (step S142). If it is judged to be the OFA mode, an OFA mode flag in the mode information is cleared (step S145). If it is judged in step S142 that the mode is not the OFA mode, the OFA mode flag in the mode information is set (step S143). This process realizes the toggle operation of the OFA switch 51 and sets the OFA mode flag. Then, a multi OFA mode flag indicating a multi mode, which is provided in a predetermined area in the working area in the RAM 5, is cleared (step S144). Through the above operation, the setting of the OFA mode flag is completed.

MULTI MODE PROCESS (FIG. 20)

When the multi switch 52 of the panel 2 is rendered ON to set the multi mode, the CPU 3 receives change data of the multi switch 52 from the scan circuit of the panel 2. The CPU 3 judges whether or not the status of the multi switch 52 has changed to an ON state (steps S150 and S151).

If it is the "ON" event in the step S151, the CPU 3 determines if the motif playing apparatus is set in OFA mode, referring to the mode information set in the working area of the RAM 5 (step S152). If it is judged that the mode is not the OFA mode, the multi mode process is terminated without operating the multi OFA mode flag. If the mode is judged in step S152 to be the OFA mode, the CPU 3 checks if the mode is the multi mode, referring to a predetermined area of working area in the RAM 5 (step S153). If it is the multi mode, the multi OFA mode flag is cleared (step S155) and the multi mode process will be terminated. If it is determined that the multi mode is not set, the multi OFA mode flag is set (step S154), and the multi mode process will be terminated. The above operation realizes the toggle operation of the multi switch 52 and the setting of the multi OFA mode flag.

TIMBRE/RHYTHM SETTING SWITCH PROCESS (FIG. 21)

When any of the switches 58, 59, 60 or 61 on the panel 2 to set a timbre or rhythm pattern switching mode is operated, the CPU 3 receives change data of the operated switch from the scan circuit of the panel 2, then checks if the status of that key is changed to the ON status (steps S160 and S161).

If it is an ON even in step S11, a flag clear process is executed first (step S162). The flag clear process clears all of a melody flag, bass flag, chord flag and rhythm flag provided in a predetermined area in the RAM 5 in association with the switches 58–61.

Then, it is determined if the switch having the ON event is the switch 58 (step S163). If the decision is affirmative, the melody flag is set (step S164), and a sequence of processes will be terminated. If it is judged in step S163 that the switch in question is not the switch 58, it is then determined if it is the switch 59 (step S165). If the switch is actually the switch 59, the bass flag is set (step S166) and the sequence of processes will be terminated. If it is judged in step S165 that the switch having the ON event is not the switch 59, it is then checked if this switch is the switch 60 (step S167). When the switch in question is the switch 60, the chord flag is set (step S168), and the sequence processes will be terminated. If it is discriminated in step S167 that the operated switch is not the switch 60, it is then checked whether or not the switch having the ON event is the switch 61 (step S169). When it is indeed the switch 61, the rhythm flag is set (step S170), and the sequence of processes will be terminated. If it is judged in step S169 that the switch in question is not the switch 61, the sequence of processes will be terminated without setting any flag.

VARIOUS NUMBER CHANGE PROCESSES (FIG. 22)

This process is to alter and set the timbre or rhythm number by the operation of the switches 53 to 56 on the panel 2. In other words, when any of the switches 53, 54, 55 or 56 is operated, the CPU 3 receives change data of that switch from the scan circuit of the panel 2, then checks if the status of the switch has changed to an ON state (steps S180 and S181).

Figure 21:
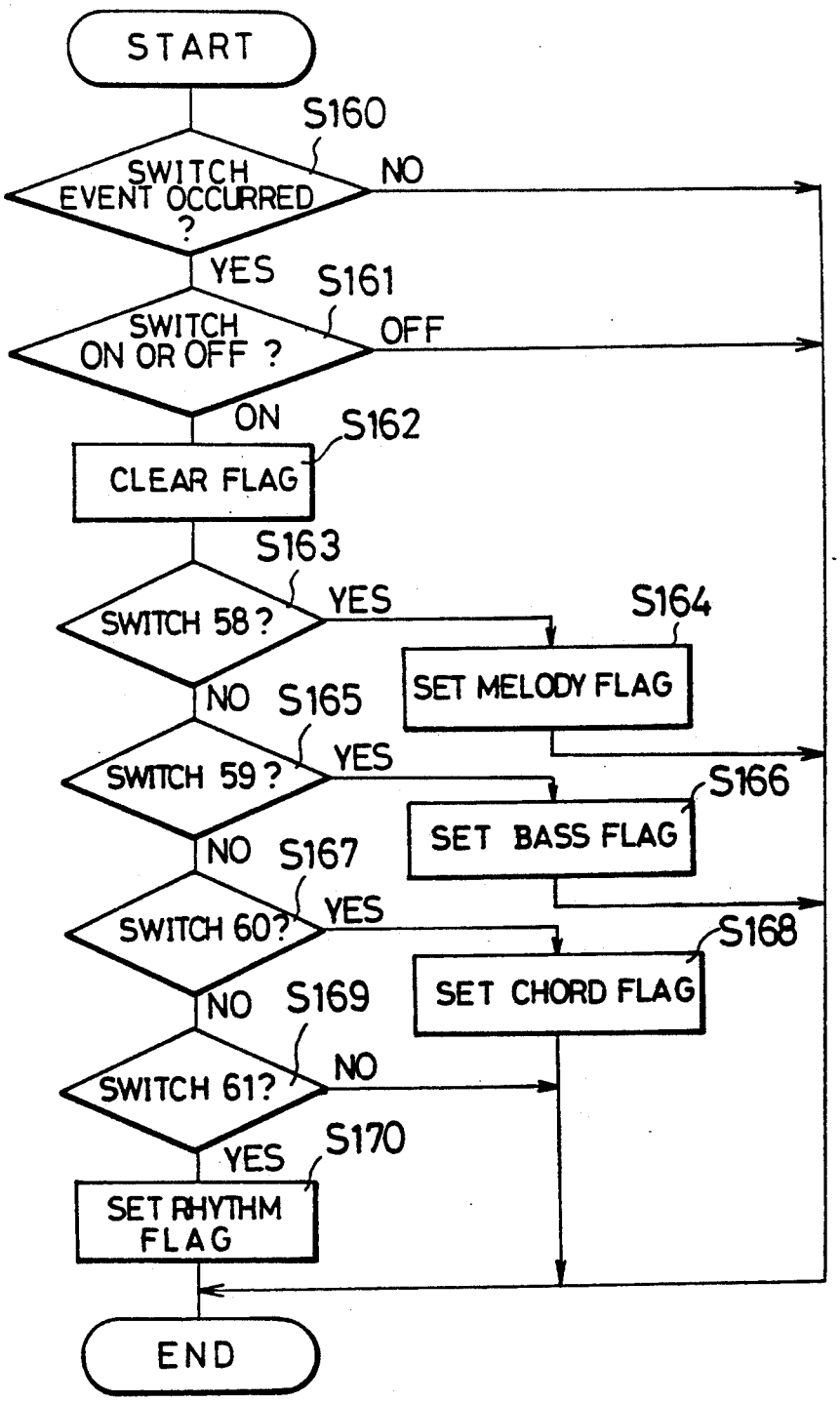
Figure 22:
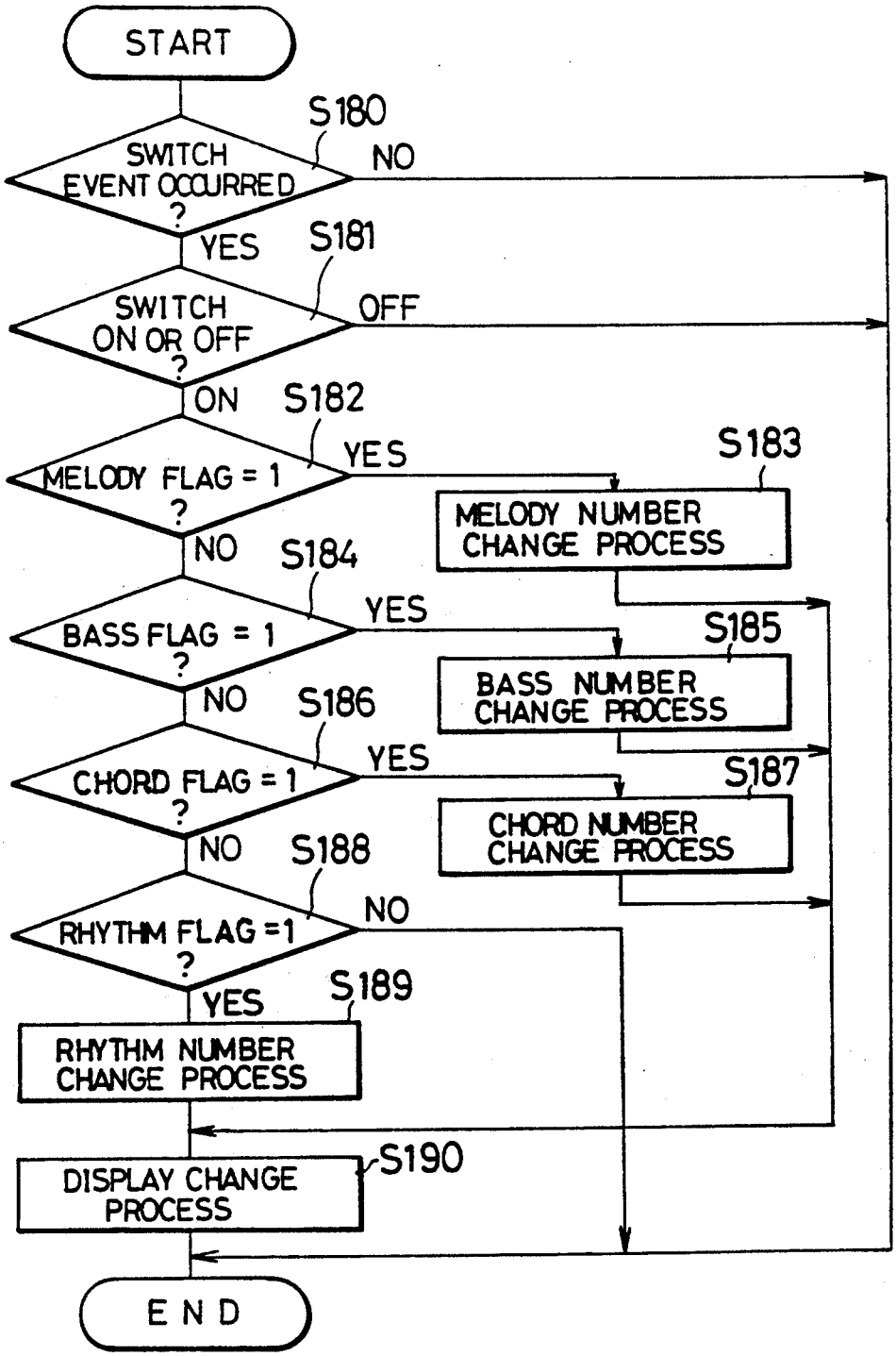
Figure 23:
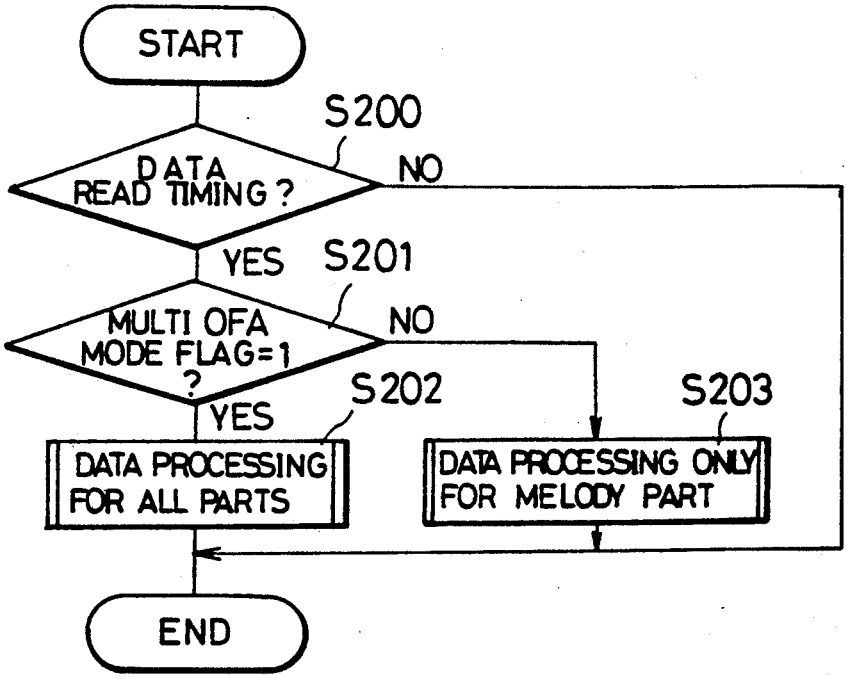
Figure 24:
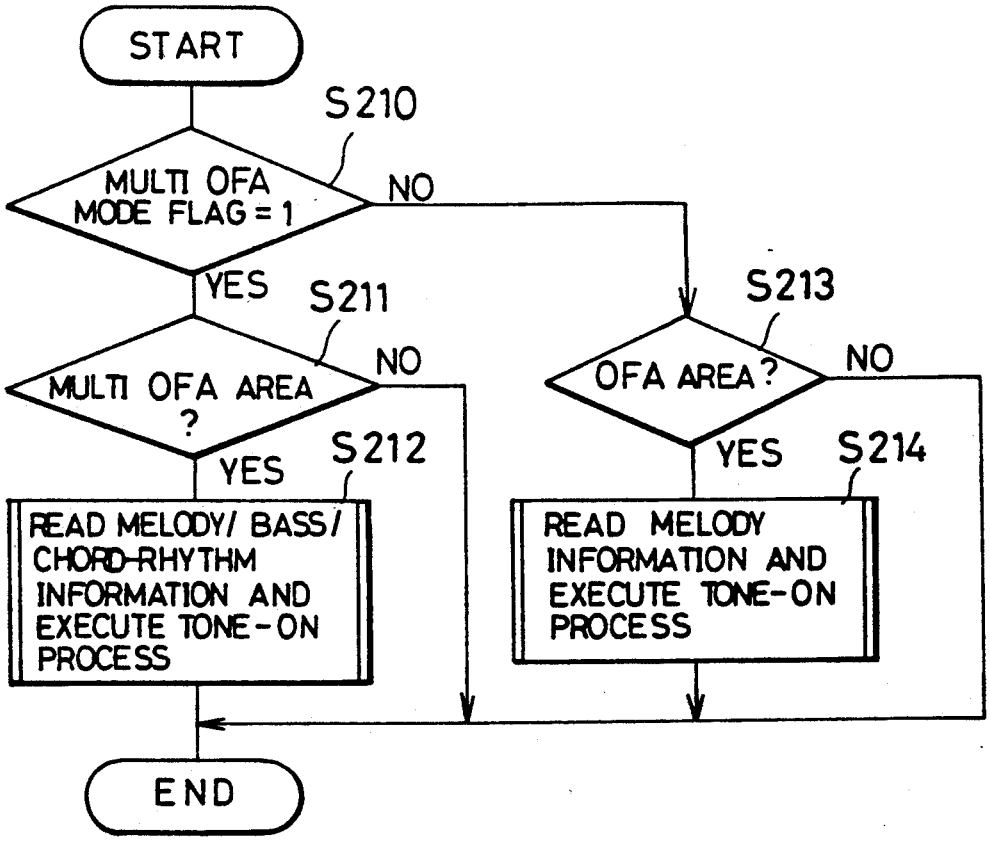

Thereafter, various number change processes are executed based on the flag set by the timbre/rhythm setting switch process (FIG. 21). More specifically, it is determined whether or not the melody flag is "1" (step S182), and if it is "1," the melody number change process is performed (step S183). This melody number change process replaces the melody number set in the RAM 5 with the one set by the switches 53 to 56. If it is determined in step S182 that the melody flag is not "1," it is then checked if the bass flag is "1" (step S184). If the bass flag is "1," the bass number change process is performed (step S185). This bass number change process replaces the bass number set in the RAM 5 with the one specified by the switches 53 to 56. If it is judged in step S184 that the bass flag is not "1," it is then checked if the chord flag is "1" (step S186). If the chord flag is "1," the chord number change process is performed (step S187). This chord number change process replaces the chord number set in the RAM 5 with the one specified by the switches 53 to 56. If it is judged in step S186 that the chord flag is not "1," it is then checked if the rhythm flag is "1" (step S188). If the rhythm flag is "1," the rhythm number change process is performed (step S189). This rhythm number change process replaces the rhythm number set in the RAM 5 with the one specified by the switches 53 to 56. If the rhythm flag is not judged to be "1" in step S188, the sequence of processes will be terminated without changing any number. When the process of changing the number of the melody, bass, chord or rhythm is completed, a display change process is executed (step S190). Through this display change process, the segment display 57 on the panel 2 displays the changed number.

DATA READ PROCESS (FIG. 23)

In the data read process, the part of the data fetched at the data read timing is determined, and a tone generating process of all the data is executed if the mode is the multi mode, and tone generation of only the melody data is effected if the mode is not the multi mode.

First, it is checked if the operation is at the data read timing (step S200). The data read timing is where the content of the counter which counts up as data reading progresses coincides with the step time in the motif data. When the timing is judged to be the data read timing, it is then checked if the multi OFA mode flag is "1" (step S201). If the multi OFA mode flag is "1," data processing of all the parts is executed (step S202). If it is not judged that the multi OFA mode flag is "1," data processing of only the melody part is executed (step S203). The data processed in the manner is sent to the tone generator 6 to generate musical tones.

KEYING-ORIENTED PROCESS IN OFA MODE (FIG. 24)

This process is a process executed when a motif is played through actual depression of a key. When a predetermined key of the keyboard 1 is depressed, it is then checked if the multi OFA mode flag is "1" (step S210). If this flag is not "1," it is determined whether or not the position of the depressed key is in the OFA area shown in FIG. 2 (step S213). If it is not judged that the depressed key belongs to the OFA area, the process in the OFA mode is not executed, and the normal keying-oriented tone generating process or the normal play is executed.

If the depressed key is judged to be one of the keys in the OFA area, motif data of melody information is read out from the RAM 5 and sent to the tone generator 6 for tone generation (step S214). That is, a motif play of only the melody is effected.

If it is judged in step S210 that the OFA mode flag is "1," it is then checked if the depressed key is one of the OFA area shown in FIG. 2 (step S211). If it is not judged that the depressed key exist in the OFA area, the process in the OFA mode is not executed, and the normal tone generation is executed. If it is judged that the depressed key is in the OFA area, however, motif data of melody, bass, chord and rhythm information are simultaneously read out from the RAM 5 and sent to the tone generator 6 for tone generation. In other words, the motif play of all the part is executed.

As described above, with data representing a motif of an accompaniment such as rhythm, bass or chord, stored in the RAM 5 and data representing a melody motif also stored in the RAM 5, a motif play only with the accompaniment or melody is possible when specified by the OFA switch 51 to set the OFA mode, and motif data of both the accompaniment and melody can simultaneously be released to generate the associated musical tones when specified by the multi switch 52 to set the multi mode in which all the parts are played. This design can solve the asynchronization of the automatic part, such as rhythm, bass or chord, with the motif part, which would occur in the prior art, and can realize a motif playing apparatus which permits an accompaniment, such as rhythm, bass or chord, to be synchronized with a melody as an ad-lib motif to thereby ensure musical performance whoever makes key depression at whatever timing.

What is claimed is:

1. A motif playing apparatus comprising:

assigning means for assigning arbitrarily-prepared ad-lib motif data to predetermined keys in a predetermined range on a keyboard having a plurality of keys, said ad-lib motif data including a plurality of continuous melody, bass, chord, or rhythm tone data assigned to each of said predetermined keys;

designation means for designating a length of said arbitrarily-prepared ad-lib motif data assigned to a predetermined key by said assigning means;

storage means for storing said arbitrarily-prepared ad-lib motif data having said length designated by said designation means in association with each of the predetermined keys on said keyboard which are assigned data by said assigning means; and tone generating means for reading out said arbitrarily-prepared ad-lib motif data from said storage means in association with said predetermined keys assigned by said assigning means and generating associated musical tones.

2. A motif playing apparatus according to claim 1, wherein said assigning means includes means for automatically assigning arbitrarily-prepared ad-lib motif data to successive unassigned keys in said predetermined range.

3. A motif playing apparatus according to claim 1, wherein said assigning means has a CPU.

4. A motif playing apparatus according to claim 4 wherein said designation means is further defined as specifying a length of arbitrarily-prepared ad-lib motif data by means of a switch provided on an operation panel.

5. A motif playing apparatus according to claim 1, wherein said designation means is further defined as specifying a length of arbitrarily-prepared ad-lib motif data by units of bars.

* * * * *

UNITED STATES PATENT AND TRADEMARK OFFICE

CERTIFICATE OF CORRECTION

PATENT NO. : 5,182,414

DATED : January 26, 1993

INVENTOR(S) : H. Takahashi

It is certified that error appears in the above-identified patent and that said Letters Patent is hereby corrected as shown below:

CLAIM 4, Col. 16, Line 45, delete "4" and substitute therefor ---1---.

Signed and Sealed this

Thirtieth Day of November, 1993

Bruce Lehman

*Attest:*

BRUCE LEHMAN

*Attesting Officer*

*Commissioner of Patents and Trademarks*